US005875666A

United States Patent [19]

Itaya

[11] Patent Number: 5,875,666

[45] Date of Patent: Mar. 2, 1999

[54] SPRING MANUFACTURING APPARATUS AND POSITION ADJUSTMENT APPARATUS FOR TOOLS

[75] Inventor: Ichiro Itaya, Tokyo, Japan

[73] Assignee: Kabushiki Kaisha Itaya Seisaku Sho, Tokyo, Japan

[21] Appl. No.: 907,332

[22] Filed: Aug. 6, 1997

[30] Foreign Application Priority Data

Aug. 23, 1996 [JP] Japan ..... 8-222812

[51] Int. Cl.[6] ..... B21F 3/02; B21F 3/10; B21F 3/04

[52] U.S. Cl. ..... 72/140; 72/138; 72/145

[58] Field of Search ..... 72/129, 135, 138, 72/142, 143, 144, 145, 442, 140

[56] References Cited

U.S. PATENT DOCUMENTS 642,339 1/1900 Krummel ..... 72/145

3,161,224 12/1964 Hediger ..... 72/145

5,259,226 11/1993 Itaya ..... 72/140

FOREIGN PATENT DOCUMENTS 7-115101 12/1995 Japan .

*Primary Examiner*—Joseph J. Hail, III

*Assistant Examiner*—Rodney Butler

*Attorney, Agent, or Firm*—Merchant, Gould, Smith, Edell, Welter and Schmidt

[57] ABSTRACT

A tool assembly 120 is attached on a forming table 101 movably in a vertical direction with respect to the forming table 101. The tool assembly 120 has a wedge tool assembly 140 which inserts a wedge tool between coils of wire W being continuously rolled by a coiling assembly 160 and growing coils having a predetermined pitch in an approximate normal-line direction with respect to the forming table 101, and a core block 123 which applies a cutting force to the wire W in cooperation with a cutting tool. This integrally moves the core block 123, the wedge tool and the like.

11 Claims, 12 Drawing Sheets

10

160

SPRING MANUFACTURING APPARATUS AND POSITION ADJUSTMENT APPARATUS FOR TOOLS

BACKGROUND OF THE INVENTION

This invention relates to a spring manufacturing apparatus for forming a compression spring, an extension spring and the like. For example, the apparatus continuously feeds a wire to be formed into a spring, to place the wire against a point tool, whereby the wire rolls into a coil spring having a predetermined coil diameter, and at the same time, providing the spring with a predetermined pitch by inserting a pitch tool between coils, and cuts the wire by a cutting tool to obtain a spring having a desired shape.

DESCRIPTION OF RELATED ART

Conventional spring manufacturing apparatuses have a forming table parallel to a wire-feeding direction. On the forming table, a core block to apply a cutting force to a wire in cooperation with a cutting tool is provided, and the cutting tool and a pitch tool are provided, opposing to each other, along a vertical direction with respect to the core block, further, a single or plurality of point tools are provided in a radial pattern with respect to the core block.

The position of the core block is arbitrarily changeable in the vertical direction with respect to the forming table, in accordance with a coil diameter. The pitch tool and the cutting tool are provided, opposing to each other, along the vertical direction, for example, slidably toward the core block. The point tool is slidably provided so as to abut against the wire being fed, thus define the coil diameter of the spring. The position of the point tool is changeable on the forming table, in accordance with a desired spring shape. The forming table defines spring-forming space in the spring manufacturing apparatus main body. The pitch tool, the point tool and the cutting tool form the wire into a desired coil spring by abutting against the wire fed by a feed roller, and slide-moving between a protrudent position where the wire is cut and a waiting position away from the wire, at predetermined timing.

For example, upon forming a compression coil spring having a uniform coil diameter along a spring-lengthwise direction, the wire is placed against the point tool and forcibly bent, and at the same time, the pitch tool is inserted between coils of the wire being continuously rolled. Thus, a coil spring having a predetermined pitch grows in a normal-line direction with respect to the forming table. Then, when the spring has a predetermined length, it is cut by the core block and the cutting tool, thus the compression coil spring is completed.

As a spring manufacturing apparatus of this type, Japanese Patent Application Laid-Open No. 7-115101 discloses a construction including a fixed platform (forming table) having a housing movable along a vertical direction. The housing contains a core block, a cutting device (cutting tool) and a pitch setting device (pitch tool). The cutting device and the pitch setting device are provided slidably toward the core block, opposing to each other, along the vertical direction with respect to the core block.

However, in this spring manufacturing apparatus, when a coil diameter or the like is changed, the core block, the point tool, the pitch tool and the cutting tool are removed from the forming table, and in accordance with necessity, they are changed for tools having different distal-end shapes and the like. Then, when the tools are set on the forming table again, the relative positional relation among the core block and the respective tools must be adjusted again.

Japanese Patent Application No. 7-115101 discloses a spring manufacturing apparatus in which a drive force of an electric motor for driving a cutting device, fixed to a housing rear wall, is transmitted by belt drive to the cutting device, while a drive force of an electric motor for driving a pitch setting device, also fixed to the housing rear wall, is transmitted via a link mechanism to the pitch setting device. In this construction, when the position of the housing is changed in a vertical direction due to change of a coil diameter or the like, the positional relation between the pitch setting device and the link mechanism must be adjusted again, which requires labor.

Further, the pitch setting device is movable in the vertical direction by the housing, whereas the drive motor for the pitch setting device is fixed to the housing rear wall and is unmovable. For this reason, to connect both devices, a complicated transmission mechanism such as the above belt mechanism and the link mechanism is necessary. In addition, as the housing is movable, it is necessary to provide the transmission mechanism with an adjustment mechanism for adjusting the positional relation between the transmission mechanism and the housing. The problem is that costs increase due to increase of the number of parts.

SUMMARY OF THE INVENTION

The present invention has been made in consideration of the above situation, and has its object to provide a spring manufacturing apparatus and a position adjustment apparatus for tools, capable of setting a coil diameter and the like, without changing the relative positional relation among a core block for assisting cutting a wire and tools for providing the wire with a predetermined coil diameter and a pitch.

Further, another object of the present invention is to provide a spring manufacturing apparatus and a position adjustment apparatus for tools capable of reducing cost by using a simplified transmission mechanism for transmitting drive forces to the tools.

According to the present invention, the foregoing objects are attained by providing a spring manufacturing apparatus having a main body and a table extending therefrom, said apparatus feeding a wire to be made into a spring coiling the wire and cutting the wire by using tools provided on the table and main body, said table having a surface approximately parallel to an axis of said wire, the apparatus comprising, on said table and main body: feeding means for feeding the wire; coiling means for coiling the wire by placing the wire against a coiling tool; coiling-tool drive means for slide-driving the coiling tool; and a base attached on the table movable in a vertical direction with respect to the table, and wherein the apparatus further comprises, on the base: pitch generation means for inserting a pitch tool between coils of the wire being continuously coiled by the coiling means and growing coils having a predetermined pitch in an approximate normal-line direction with respect to the table; pitch-tool drive means for slide-driving the pitch tool; and a core block for applying a cutting force to the wire in cooperation with a cutting tool for cutting the wire.

Further, the foregoing objects are attained by providing a position adjustment apparatus used in a spring manufacturing apparatus having: adjacent to a table having a surface approximately parallel to an axis of said wire feeding means for feeding a wire to be made into a spring; coiling means, provided on the table, for coiling the wire by placing the wire against a coiling tool; coiling-tool drive means for slide-driving the coiling tool, pitch generation means for inserting a pitch tool between coils of the wire being continuously coiled by the coiling means and growing coils having a predetermined pitch in an approximate normal-line direction with respect to the table; pitch-tool drive means for slide-driving the pitch tool; and a core block for applying a cutting force to the wire in cooperation with a cutting tool for cutting the wire; the position adjustment apparatus, for adjusting a positional relationship of said tools and/or the core block with respect to said table, comprising a base, provided on the table, movable in a vertical direction with respect to the table, wherein the pitch generation means, the pitch-tool drive means and the core block are mounted on the base, and wherein the base is moved in the vertical direction with respect to the table without changing the positional relationship among the pitch generation means, the pitch-tool drive means and the core block.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENT

Preferred embodiment of the present invention will now be described in detail in accordance with the accompanying drawings.

[Outline of Spring Manufacturing Apparatus]

Figure 1:
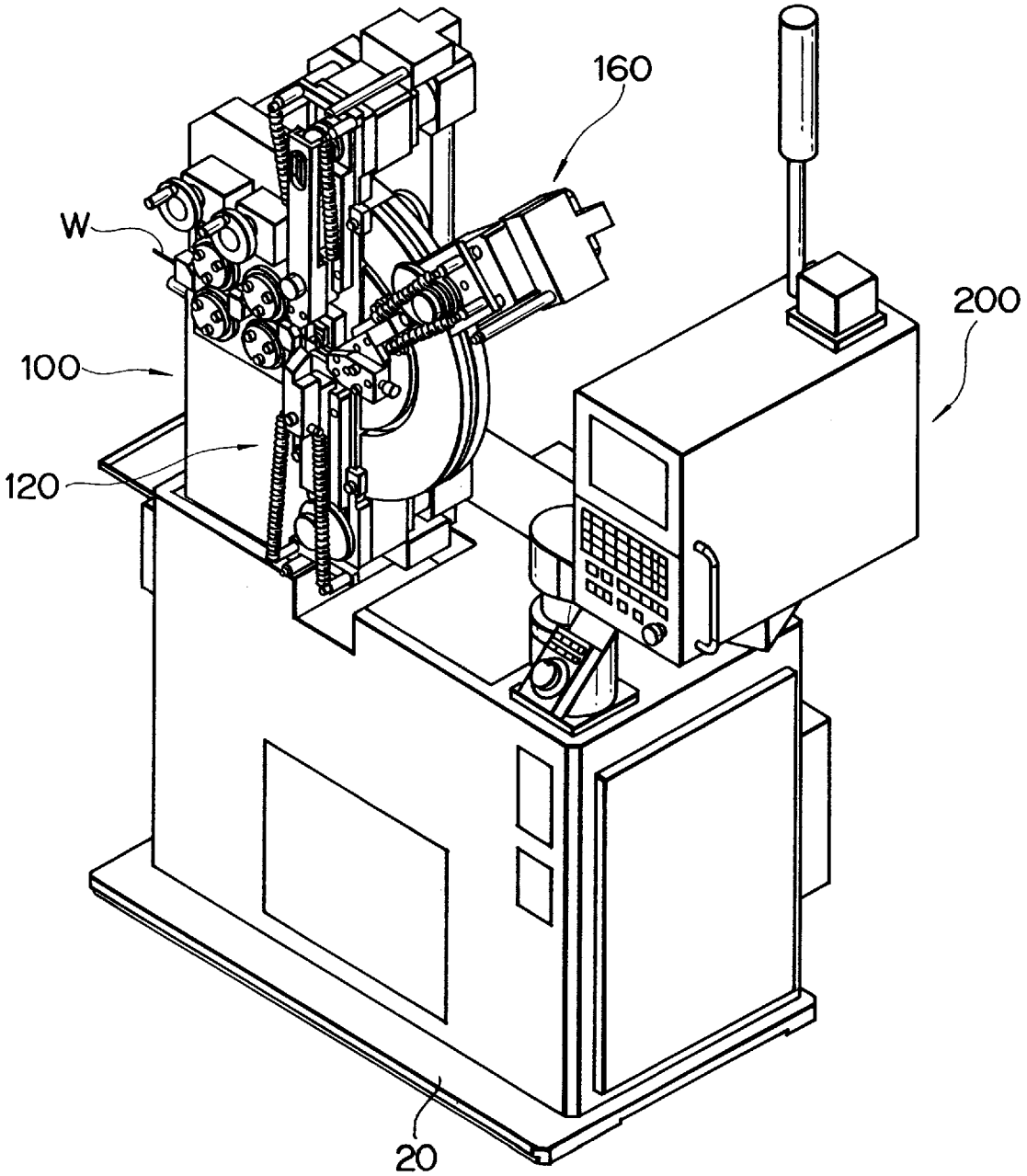
FIG. 1 is a perspective view showing the structure of a spring manufacturing apparatus according to an embodiment of the present invention.

FIG. 1 is a perspective view showing the structure of a spring manufacturing apparatus according to an embodiment of the present invention.

In FIG. 1, a spring manufacturing machine 10 of the present embodiment mainly forms compression coil springs having a conical shape, a biconcave shape, a biconvex shape and the like, by providing a wire being fed and continuously rolled into coils with a predetermined coil diameter and a predetermined pitch. The spring manufacturing machine 10 can also form extension coil springs and torsion coil springs.

The spring manufacturing machine 10 comprises a box-shaped/rectangular-parallelepiped machine main body 20, a coiling assembly 100 provided on the upper surface of the machine body 20, and a controller 200 for controlling the overall machine.

As described later, the coiling assembly 100 comprises a coiling assembly main body, a feed mechanism provided in the coiling assembly main body for feeding a wire W, a tool assembly 120 having a core block, a wedge tool and a push tool as pitch-forming tools, a cutting tool, and a point-tool assembly having a point tool.

The coiling assembly 100 has a function for feeding the wire W by the feed mechanism, a function for forming a coil spring having a predetermined coil diameter by forcibly bending the wire W being fed by using the point-tool assembly while providing the spring with a predetermined pitch using the tool assembly 120, and a function for finally obtaining a single coil spring by cutting the spring having a desired shape.

[Coiling Assembly]

Next, the coiling assembly 100 will be described in detail.

Figure 2:
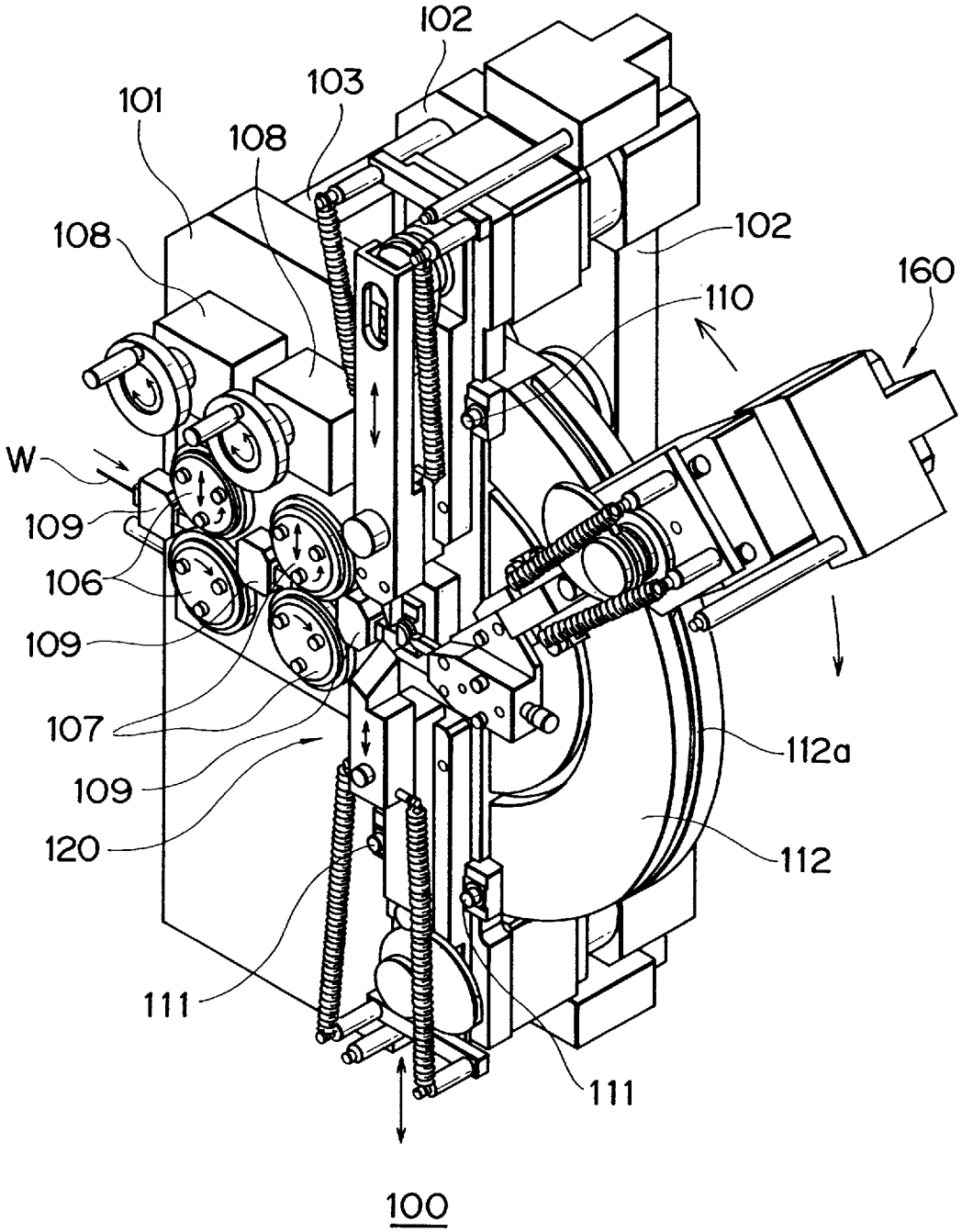
FIG. 2 is a perspective view showing in detail the structure of a coiling assembly in FIG. 1.
Figure 3:
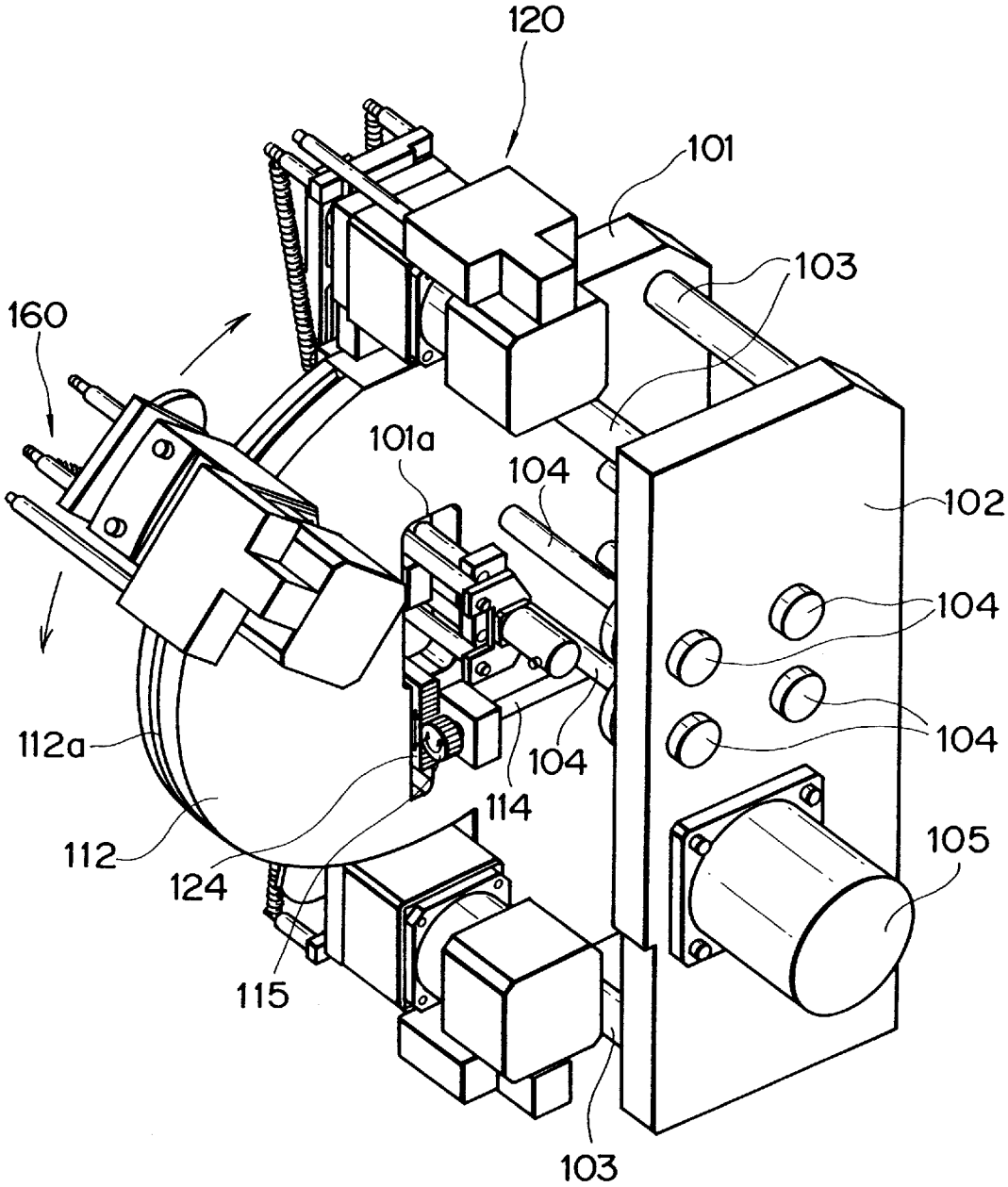
FIG. 3 is a perspective view showing in detail the structure of a coiling assembly in FIG. 1, viewed from the rear of the assembly.
Figure 4:
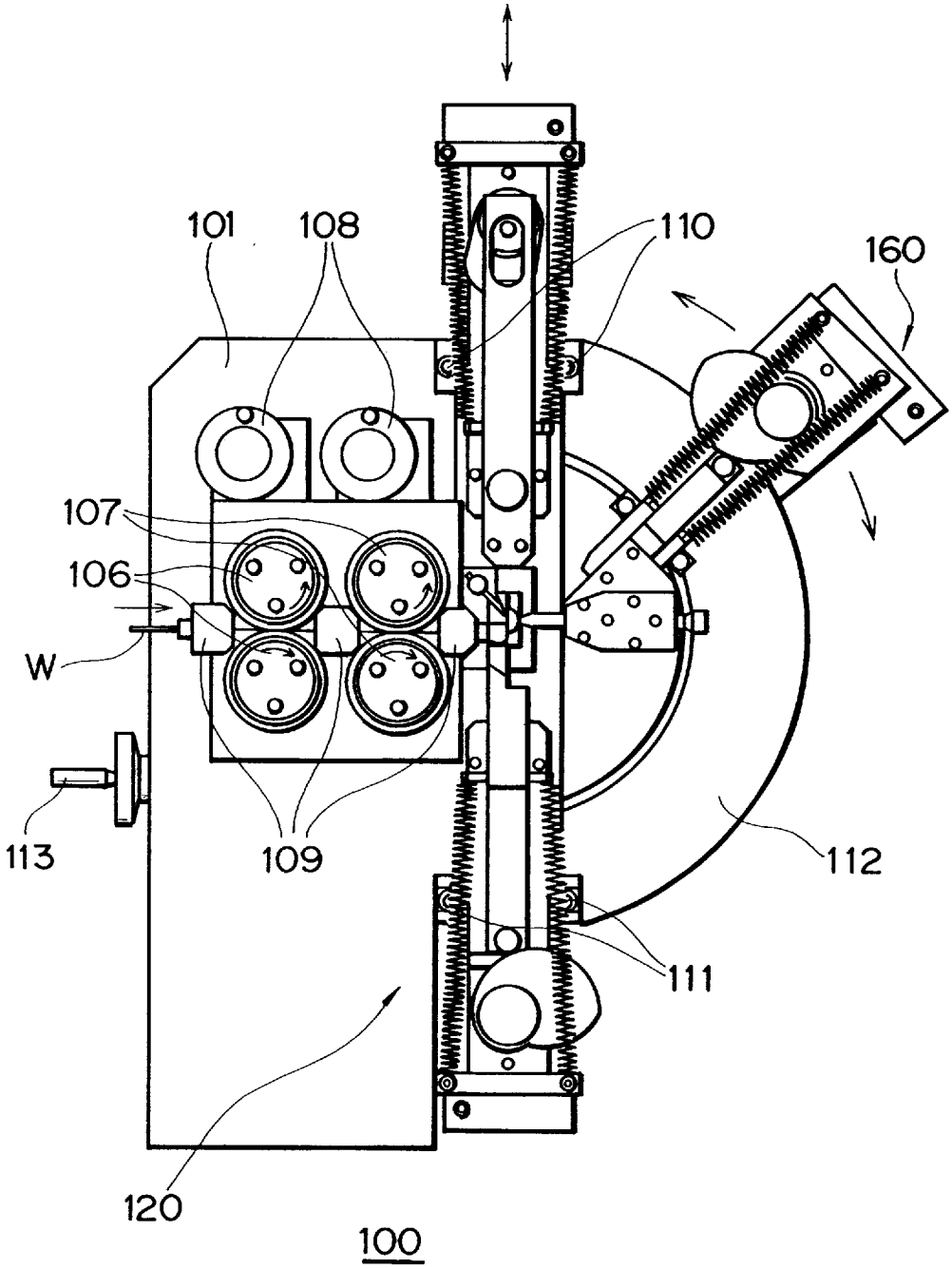
FIG. 4 is a front view of the coiling assembly in FIG. 2.

FIG. 2 is a perspective view showing in detail the coiling assembly 100 in FIG. 1. FIG. 3 is a perspective view showing in detail the coiling assembly 100 in FIG. 2, from the rear of the assembly. FIG. 4 is a front view of FIG. 2.

In FIGS. 2 to 4, the coiling assembly 100 comprises a front coiling assembly main body 101 and a rear coiling assembly main body 102, both fixed to the machine main body 20. The front and rear coiling assembly main bodies 101 and 102, of metallic material and the like having a plate thickness with a predetermined strength, are connected by a plurality of connection arms 103 at a plurality of upper and lower portions. The front and rear coiling assembly main bodies 101 and 102 are connected by the connection arms 103, with a predetermined gap between them.

Three wire feed liners 109 for guiding the wire W in a wire-feed direction (from the left to the right in FIG. 4) are provided, at predetermined intervals, in front of the front coiling assembly main body 101. A pair of upstream feed rollers 106 and a pair of downstream feed rollers 107 are rotatably provided at the intervals among the wire feed liners 109.

As shown in FIG. 3, the upstream and downstream feed rollers 106 and 107 are rotated by feed roller shafts 104, supported between the front coiling assembly main body 101 and the rear coiling assembly main body 102, and a feed-roller driver motor 105 which rotate-drives these feed roller shafts 104 by a belt mechanism or gear mechanism. The feed-roller drive motor 105 is fixed to the rear coiling assembly main body 102. The upper roller of the upstream feed rollers 106 and the upper roller of the downstream feed rollers 107 can be moved by a press roller 108 in the vertical direction. The press roller 108 controls the pressing force on the wire W by moving the respective upper rollers in the vertical direction.

The wire W is guided by the wire feed liners 109 by rotation of the upstream and downstream feed rollers 106 and 107, in the wire-feed direction, thus fed into spring-forming space to be described later.

The front coiling assembly main body 101 has a semi-circular table 112 extending in the wire-feed direction. The front coiling assembly main body 101 and the semicircular table 112 form a plane parallel to the wire-feed direction. The plane functions as a forming table defining the spring-forming space.

The semicircular table 112 has a guide groove 112*a* along the circumference of the semicircular table 112 on the circumferential surface. In the guide groove 112*a*, a point tool assembly 160 to be described later is provided movably on the circumferential surface of the semicircular table 112. The point tool assembly 160 is fixed via a bolt mechanism (or a screw mechanism), at an arbitrary position, to the semicircular table 112, movably along the guide groove 112*a*.

Around a connection portion of the semicircular table 112 in the front coiling assembly main body 101, a tool assembly 120 having a core block, a wedge tool and a push tool as pitch forming tools, a cutting tool, and drive motors for the respective tools, is provided. The tool assembly 120 is movable in a vertical direction with respect to the front coiling assembly 101 by a predetermined distance.

As shown in FIG. 4, the tool assembly 120 is fixed to the front coiling assembly main body 101 by an upper fixer 110 and a lower fixer 111. The upper fixer 110 and the lower fixer 111 are bolt mechanisms (or screw mechanisms). The tool assembly 120 FIG. 3 is movable in the vertical direction by a pinion shaft 114 supported at the rear of the front coiling assembly main body 101, a pinion gear 115 fixed to the pinion shaft 114, and a rack-and-pinion mechanism comprising a rack 124 provided in the tool assembly 120 and engaged with the pinion gear 115. The rack 124 protrudes backward via a rectangular opening 101*a* of the front coiling assembly main body 101, to be engaged with the pinion gear 115. As shown in FIG. 4, the pinion shaft 114 is rotated by a handle 113 provided on the side of the front coiling assembly main body 101, and the rotation of the pinion shaft moves the tool assembly 120 upward/downward.

The tool assembly 120 is moved upward/downward for the purpose of moving the core block in accordance with change of a coil diameter.

To move the tool assembly 120 upward/downward, first, the fixing portions of the upper fixer 110 and the lower fixer 111 are loosened, then, the tool assembly 120 is moved to a desired position while the handle 113 is turned, and when the position of the tool assembly 120 has been determined, the upper fixer 110 and the lower fixer 111 are tightened.

[Tool Assembly]

Next, the tool assembly 120 will be described in detail.

Figure 5:
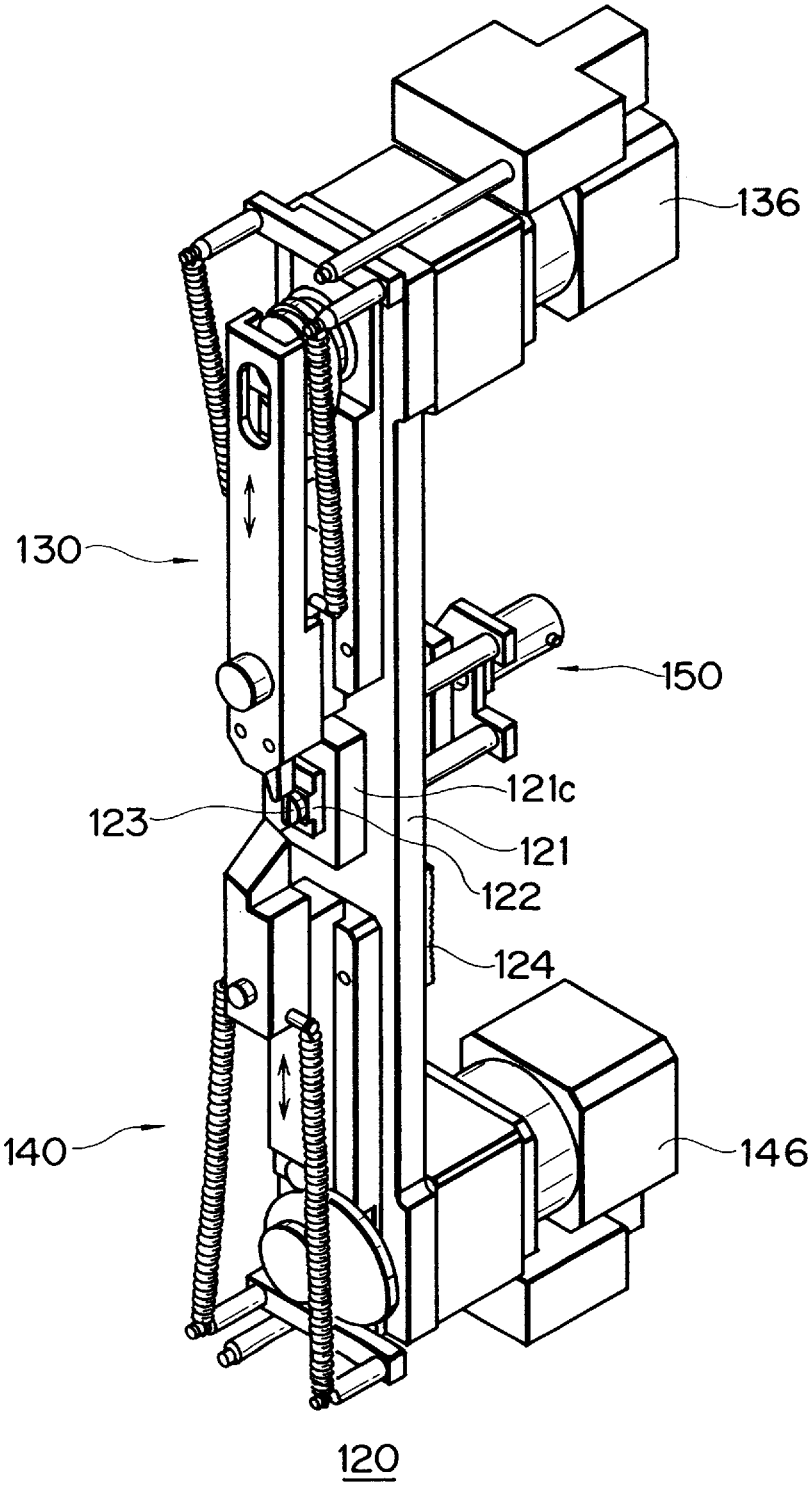
FIG. 5 is a perspective view showing in detail a tool assembly in FIG. 2.
Figure 6:
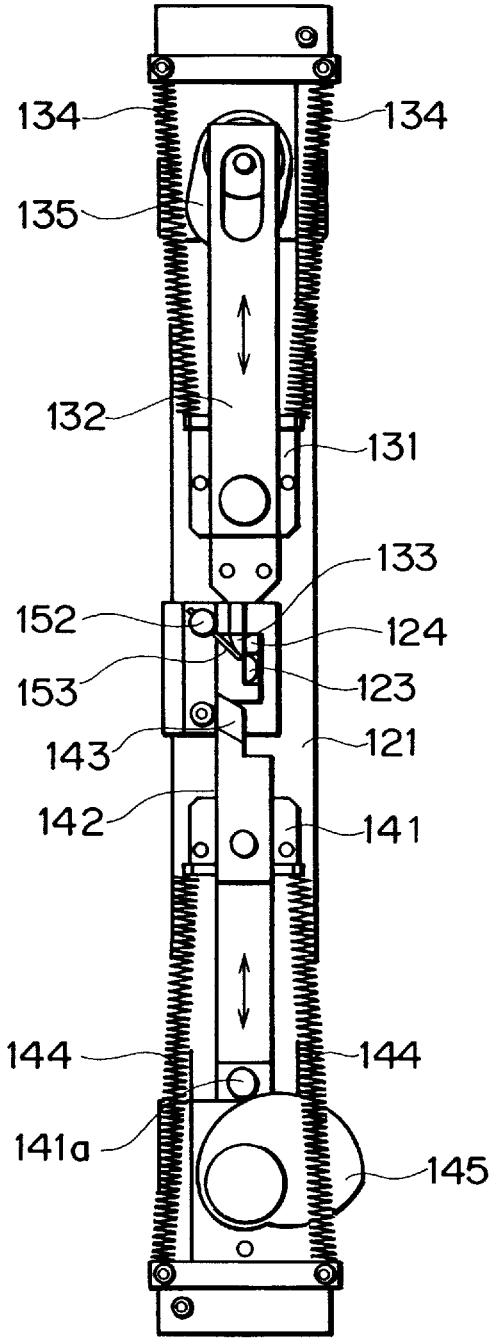
FIG. 6 is a front view of the tool assembly in FIG. 5.
Figure 7:
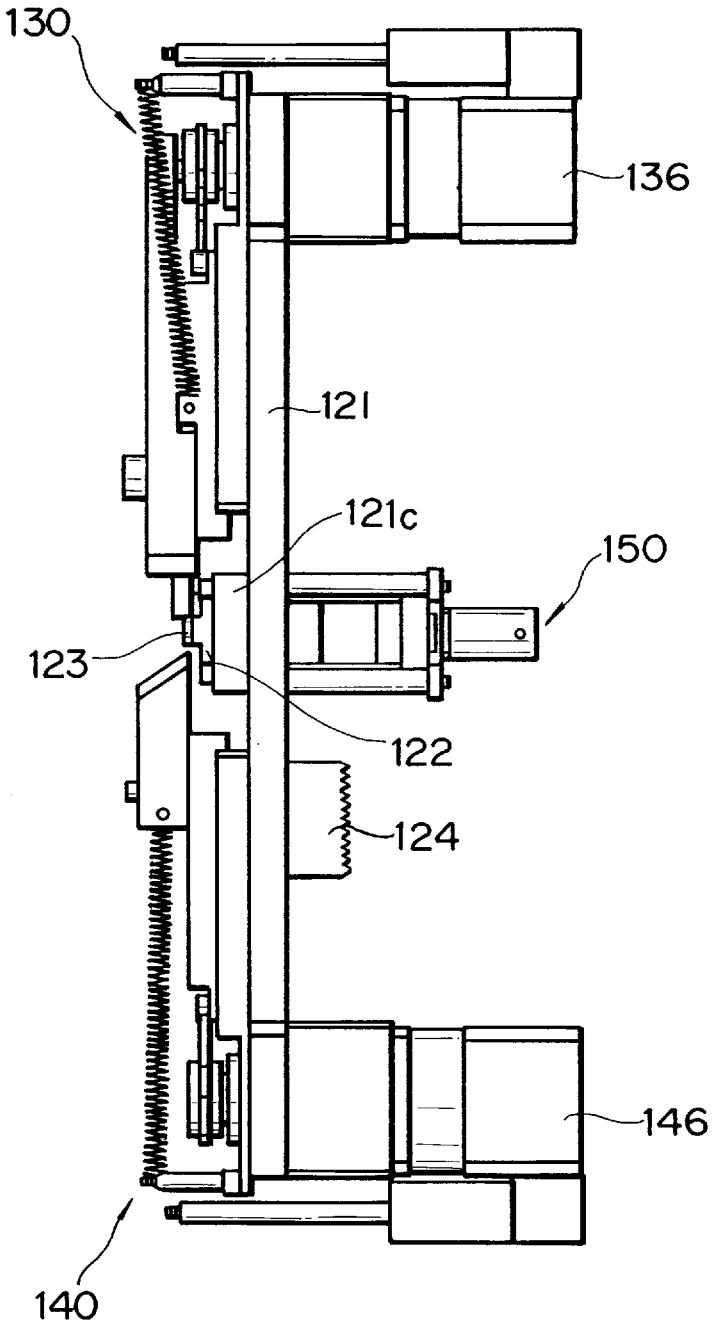
FIG. 7 is a side view of the tool assembly in FIG. 5.
Figure 8:
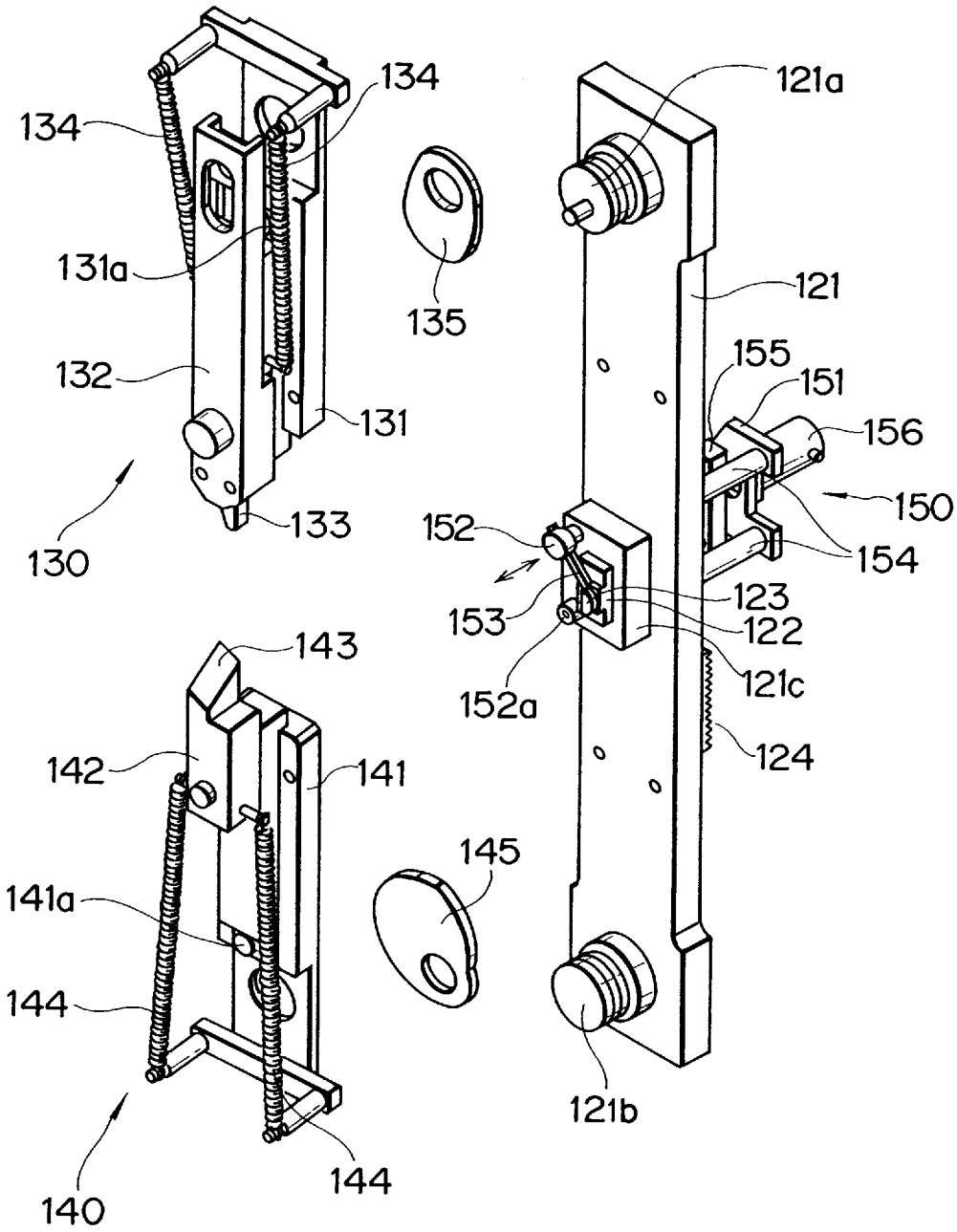
FIG. 8 is a perspective view showing in detail the tool assembly in FIG. 5 when disassembled.

FIG. 5 is a perspective view showing in detail the tool assembly 120 in FIG. 2. FIG. 6 is a front view showing the tool assembly in FIG. 5. FIG. 7 is a side view showing the tool assembly 120 in FIG. 5. FIG. 8 is a perspective view showing the tool assembly when disassembled.

In FIGS. 5 to 8, the tool assembly 120 has a long and narrow tool assembly base 121, a core-bar block 122 provided at approximately the center of the tool assembly base 121, and a cutting tool assembly 130 and a wedge tool assembly 140, both slidably provided on the tool assembly base 121.

The cutting tool assembly 130 and the wedge tool assembly 140 are provided along a vertical direction with respect to a core block 123 having a semicircular cross section, integrally formed with the core-bar block 122, opposing to each other. The cutting tool assembly 130 and the wedge tool assembly 140 are provided slidably with respect to the core block 123. The core-bar block 122 and the core block 123 are fixed onto a core block pedestal 121*c* protruded at approximately the center of the tool assembly base 121. Further, a push tool assembly 150 to be described later is provided from the core block pedestal 121*c* to the rear of the tool assembly base 121. The rack 124 is provided at the rear of the tool assembly base 121 and at a lower part of the push tool assembly 150, such that the tool assembly base 121 is movable in the vertical direction. At the rear of the upper end of the tool assembly base 121, a cutting-tool drive motor 136 for driving the cutting tool to be described later is provided. Further, at the rear of the lower end of the tool assembly base 121, a wedge-tool drive motor 146 for driving the wedge tool to be described later is provided.

As shown in FIG. 4, the tool assembly 120 is designed such that the core block 123 is provided at approximately the center of the semicircular table 112, the cutting tool assembly 130 and the wedge tool assembly 140 are provided along the diameter of the semicircular table 112 in the vertical direction, and the point tool assembly 160 is provided along the radius of the semicircular table 112.

<Cutting Tool Assembly>

As shown in FIGS. 6 to 8, on the tool assembly base 121, the cutting tool assembly 130 is provided on the upper side with respect to the core block 123. The cutting tool assembly 130 has a cutting-tool assembly base 131 fixed on the tool assembly base 121 and a cutting tool slide 132 slidably provided on the cutting-tool assembly base 131. The cutting tool 133, which is exchangeable, for cutting the wire is attached to the distal end of the cutting tool slide 132 on the core block side. The cutting tool slide 132 is biased upward by two extension coil springs 134 provided at its sides. The extension coil springs 134 are extended from the cutting tool slide 132 to the upper end of the cutting-tool assembly base 131. At this upper part of the cutting-tool assembly base 131, a cylindrical contact 131*a* is provided at the rear of the cutting tool slide 132 side. The contact 131*a* is always in contact with the surface of a cam 135 by the biasing operation of the two extension coil springs 134. The cam 135 is fixed to an upper support arm 121*a* rotatably supported at the upper end of the tool assembly base 121. The upper support arm 121*a* is connected to the cutting-tool drive motor 136 behind the upper support arm 121*a*, and the support arm 121*a* rotates the cam 135 at predetermined timing. A stroke width of the cutting tool slide 132 is determined by the shape of the cam 135. When cutting the wire W, as the cam 135 rotates, the cutting tool slide 132 is slide-driven, against the biasing force of the springs 134, between a protrudent position where a cutting force is applied to the wire W and a waiting position away from the wire W, in cooperation with the core lock 123. The cutting tool 133 is slide-driven along he diameter of the semicircular table 112 in the vertical direction.

<Wedge Tool Assembly>

As shown in FIGS. 6 to 8, the wedge tool assembly 140 is provided on the tool assembly 121 on the lower side with respect to the core block 123. The wedge tool assembly 140 has a wedge-tool assembly base 141 fixed onto the tool assembly 121 and a wedge tool slide 142 slidably provided on the wedge-tool assembly base 141. An exchangeable wedge tool 143 having a width becoming narrower toward its distal end is attached to the upper end of the wedge tool slide 142. The wedge tool slide 142 is biased downward by two extension coil springs 144 provided at its sides. The extension coil springs 144 are extended from the lower end of the wedge-tool assembly base 141 to the wedge tool slide 142. At this lower part of the wedge-tool assembly base 141, a cylindrical contact 141*a* is provided at the rear of the wedge tool slide 142 side. The contact 141*a* is always in contact with the surface of a cam 145 by the biasing operation of the two springs 144. The cam 145 is fixed to a lower support arm 121*b* rotatably supported at the lower end of the tool assembly base 121. The lower support arm 121*b* is connected to the wedge-tool drive motor 146 behind the lower support arm 121*b*, and the support arm 121*b* rotates the cam 145 at predetermined timing. A stroke width of the wedge tool slide 142 is determined by the shape of the cam 145. When the wire W is rolled into coils by the point tool to be described later, the wedge tool slide 142 is slide-driven by the biasing force of the springs 144 between a protrudent position where the wedge tool slide 142 intervenes between coils to form a predetermined pitch and a waiting position away from the wire W. Similar to the cutting tool 133, the wedge tool 143 is slide-driven along the diameter of the semicircular table 112 in the vertical direction.

<Push Tool Assembly>

As shown in FIGS. 6 to 8, the push tool assembly 150 is provided on the core block pedestal 121*c* and at the rear of the tool assembly base 121. A push-tool assembly base 151, fixed to the tool assembly base 121 by a plurality of connection arms 154, is fixed to the rear of the tool assembly base 121. The push-tool assembly base 151 is fixed to the push-tool drive motor 156. The push-tool drive motor 156 is connected to a push-tool shaft extending to the core block pedestal 121*c*. The push tool shaft 152 is connected via a slide mechanism 155 which slides the push tool shaft 152 along its lengthwise direction by rotation of the push-tool drive motor 156. Further, a push tool 153 is fixed to the end of the push tool shaft 152 on the core block pedestal 121*c*. The push tool 153 is slidable along a normal-line direction of the tool assembly base 121 (the lengthwise direction of the push tool shaft 152) by slide-moving of the push tool shaft 152 by the rotation of the push-tool drive motor 156. When the wire W is rolled into coils by the point tool to be described later, the push tool 153 is slide-driven between a protrudent position where it sequentially intervenes between coils of the wire being continuously rolled, to form a predetermined pitch and a waiting position where the push tool shaft 152 is withdrawn from the wire W. Further, the push tool shaft 152 can be moved to a position symmetric with respect to the core block 123 in the vertical direction. That is, the push tool shaft 152 is moved from the position as shown in FIG. 6 to a position 152*a* diagonally lower than the core block 123 as shown in FIG. 8. The position where the push tool 153 is attached is determined by a rolling direction of the wire W. That is, in FIG. 4, if the wire W is rolled in a clockwise direction, the push tool 153 is attached to the push tool shaft 152 at the position as shown in FIGS. 6 and 8, while if the wire W is rolled in a counterclockwise direction, the push tool 153 is moved to the push tool shaft position 152*a* as shown in FIG. 8.

Note that upon spring formation, the above-described wedge tool 143 and the push tool 153 are not used at the same time, but the appropriate one of these tools is selected in accordance with the characteristic of the wire W.

[Point Tool Assembly]

Next, the point tool assembly 160 will be described in detail.

Figure 9:
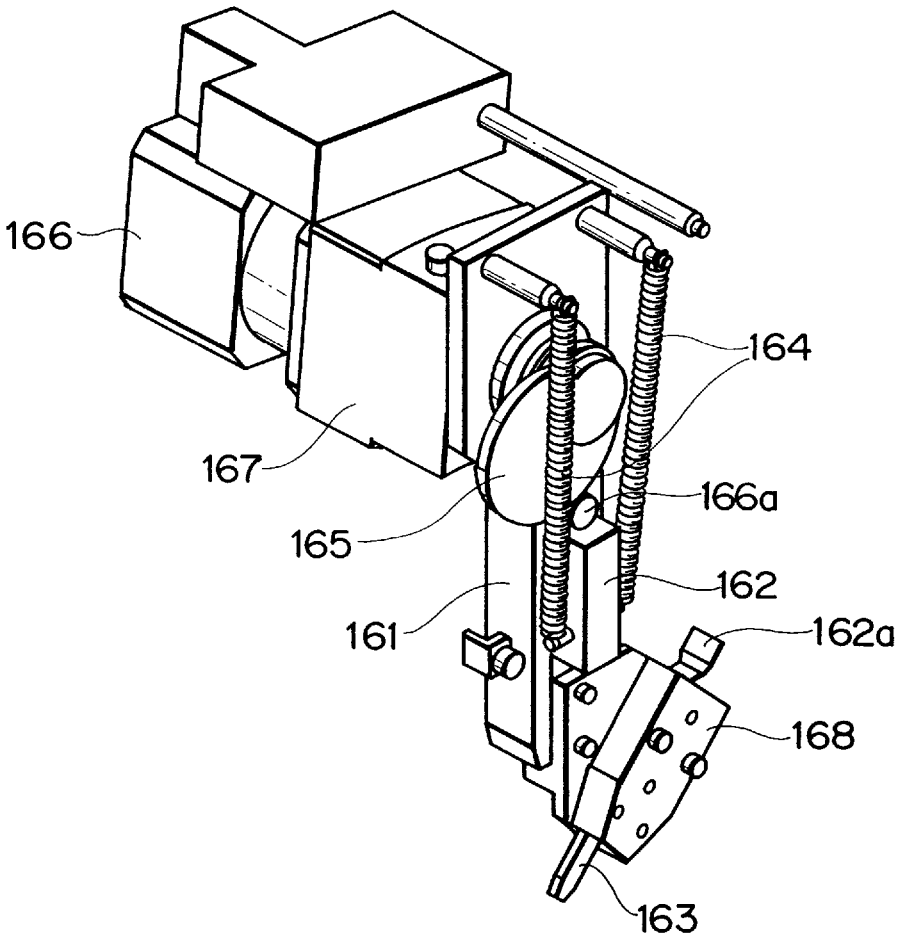
FIG. 9 is a perspective view showing in detail the point tool assembly shown in FIGS. 1 to 4.

FIG. 9 is a perspective view showing in detail the point tool assembly shown in FIGS. 1 to 4.

In FIG. 9, the point tool assembly 160 has a slide block 167 movable along the guide groove 112*a* shown in FIG. 2, a point-tool assembly base 161 fixed to the slide block 167, and a point tool slide 162 slidably provided on the point-tool assembly base 161. An exchangeable point tool 163 having a flat end surface is attached to the end of the point tool slide 162 via a point-tool support arm 168. The point tool slide 162 is biased upward by two extension coil springs 164 provided at its sides. The extension coil springs 164 are extended from the upper end of the point-tool assembly base 161 to the point tool slide 162. Further, on the point tool slide 162, a cylindrical contact 166*a* is provided at the other side of the core block side. The contact 166*a* is always in contact with the surface of a cam 165 by the biasing operation of the extension coil springs 164. The cam 165 is rotatably supported by the slide block 167. The cam 165 is connected to a point-tool drive motor 166 provided at the rear of the slide block 167 via a shaft (not shown), and the cam 165 rotates at predetermined timing. The stroke width of the point tool slide 162 is determined by the shape of the cam 165. The point tool slide 162 is slide-driven between a protrudent position where the point tool 163 is abutted against the wire W being fed to roll the wire into coils and a waiting position away from the wire W by the biasing force of the springs 164. Further, the point tool support arm 168 has a micrometer 162*a* for minute adjustment of the position of the point tool.

As shown in FIG. 4, the point tool slide 162 is slide-driven from the circumferential end surface of the semicircular table 112 along the radius of the table. The point tool 163 is provided horizontally along the wire-feed direction so as to abut against the wire W in a flat plane.

Note that in a case where the semicircular table 112 has a plurality of point tool assemblies 160 on its circumferential surface, the point-tool support arm 168 can be exchanged with another one so that the point tool 163 can be attached in a slide direction of the point tool slide 162.

[Spring Manufacturing Procedure]

Next, a procedure of manufacturing a spring by the spring manufacturing machine 10 of the present embodiment will be described in detail.

Figure 10:
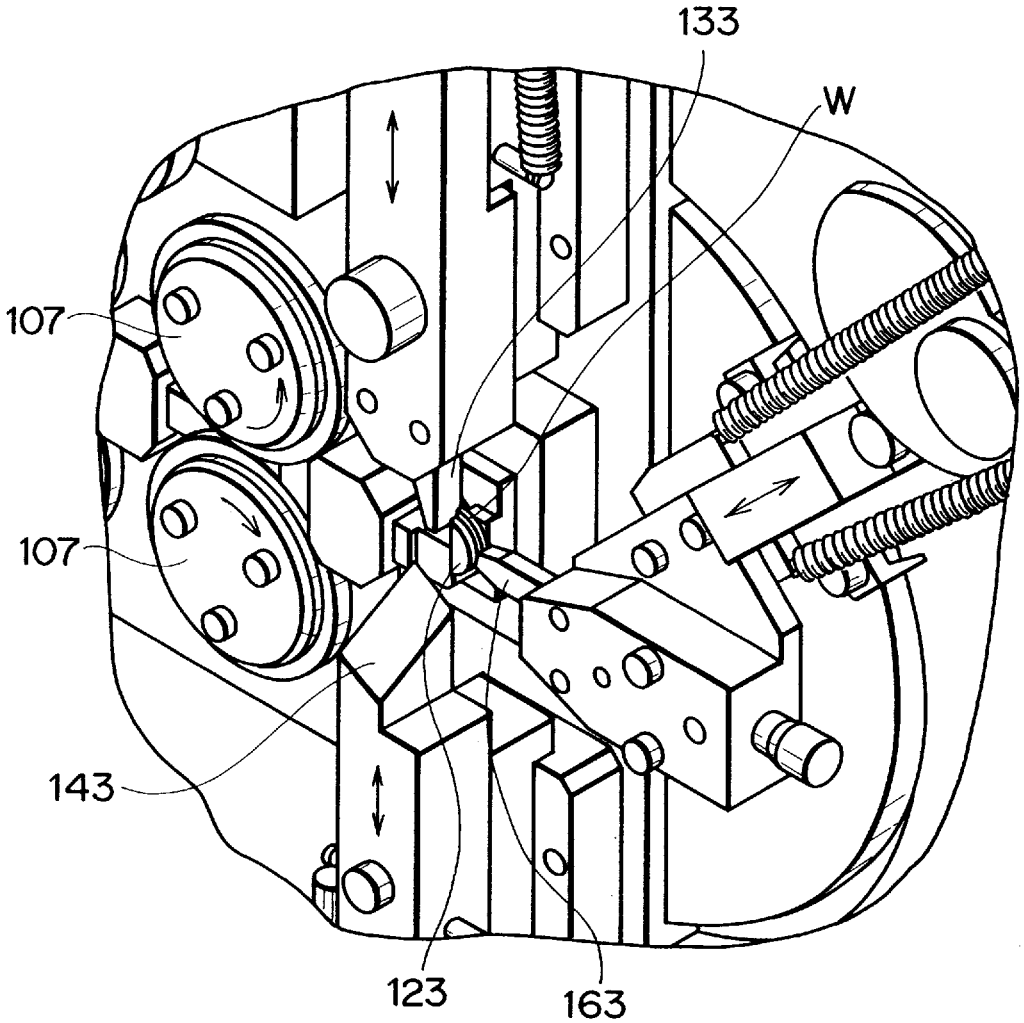
FIG. 10 is an enlarged view showing spring forming space in FIG. 2.

FIG. 10 is an enlarged view showing the spring forming space in FIG. 2.

In FIG. 10, an example where a compression coil spring having a uniform coil diameter along a spring lengthwise direction is formed by using the wedge tool 143 will be described. First, as a preparation stage, the position of the core block 123 is determined by adjust-moving the tool assembly 120 shown in FIG. 2 in the vertical direction, based on a desired coil diameter. That is, the fixing portions of the upper fixer 110 and the lower fixer 111 are loosened, then, the tool assembly 120 is moved to a desired position while the handle 113 is turned, and when the position of the tool assembly 120 has been determined, the upper fixer 110 and the lower fixer 111 are fastened.

When the position of the tool assembly 120 has been adjusted, the point tool assembly 160 is moved along the guide groove 112*a*, based on the position of the core block 123 and the desired coil diameter. At this preparation stage, it is basically unnecessary to change the relative positional relation among the core block 123, the cutting tool 133 and the wedge tool 143, since when attached to the tool assembly 120, the relative positional relation among the core block 123, the cutting tool 133 and the wedge tool 143 has already been adjusted. Note that if the shape or type of the tools are changed, minute adjustment of the relative positional relation is performed in accordance with necessity.

When the operation in the preparation stage has been completed, the point tool 163 is slid to the protrudent position close to the core block 123, and the wedge tool 143 is slid to the protrudent position also close to the core block 123. The cutting tool 133 is at the waiting position away from the core block 123. In this status, the wire W is fed by the rotation of the feed rollers 107. The wire W abuts against the end surface of the point tool 163 and forcibly bent. As the wire W is continuously fed, the wire W continuously rolled into coils, while coils grow along the normal line with respect to the spring forming table. The wedge tool 143 intervenes between coils of the wire continuously bent, thus providing a predetermined pitch to the coils growing along the normal line with respect to the spring forming table. When a spring of a predetermined length has been obtained, the cutting tool 133 is slid toward the core block 123 to cut the wire, thus one compression coil spring is completed.

Note that in the above spring manufacturing procedure, if the push tool 153 is employed, the wedge tool 143 is removed from the wedge tool assembly 140 so that the wedge-tool drive motor 146 is not activated. Then, the point tool 163 is slid to the position close to the core block 123, and at the same time, the push tool 153 is moved to the protrudent position close to the core block 123 in accordance with a desired pitch.

When forming compression coil springs having a conical shape, a biconcave shape, a biconvex shape and the like, the wire W is continuously fed, while the wedge tool 143 is slid to the position close to the core block 123 or the push tool is moved to the protrudent position also close to the core block 123, the protrudent position of the push tool 153 is changed in accordance with the desired pitch, and at the same time, the distance between the point tool 163 and the core block 123 is changed in accordance with the desired coil pitch.

Note that in the above spring manufacturing procedure, the wire-feed speed of the wire W and drive controls of the respective tools are controlled by a control block to be described later with reference to FIG. 12.

[Function by Integration of Tool Assembly]

Next, the function of the tool assembly 120 having the construction as above will be described.

Figure 11:
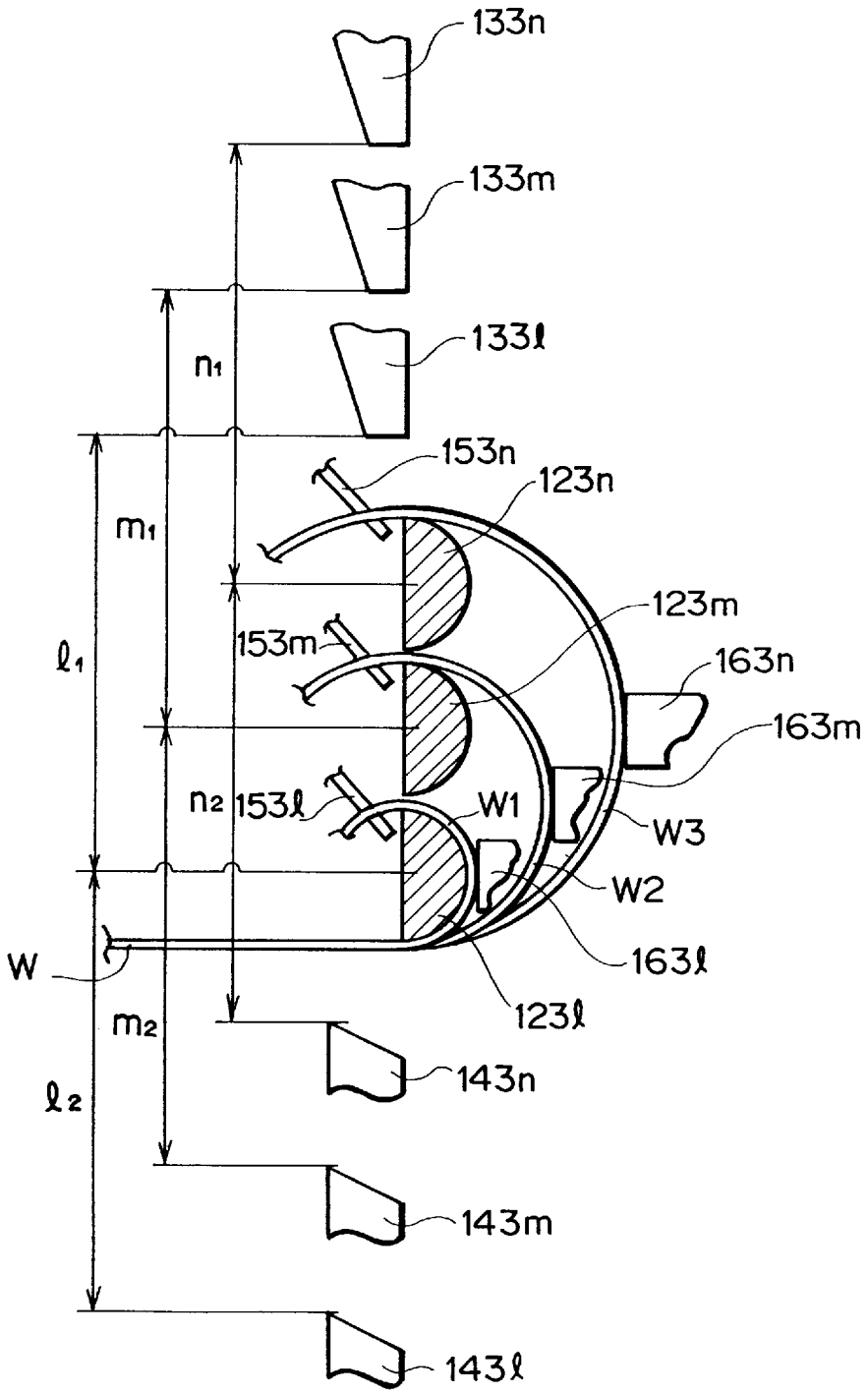
FIG. 11 is a schematic view explaining the operation of the tool assembly in FIG. 5.

FIG. 11 is a schematic view explaining the function of the tool assembly in FIG. 5.

In FIG. 11, as the tool assembly 120 of the present embodiment is movable in the vertical direction in a state where all the core block 123, the cutting tool assembly 130, the wedge tool assembly 140, the push tool assembly 150 and the point tool assembly 160 are mounted, even if the coil diameter, for example, of the spring is changed as represented as wires W1 to W3, the coil diameter can be set to a desired value without changing the relative positional relation among the core block 123*l–n*, the cutting tool 133*l–n*, the wedge tool 143*l–n*, the push tool 153*l–n* and the point tool 163*l–n*.

That is, as shown in FIG. 11, assuming that, regarding the wire W1 set to have a coil diameter l, the distance between the core block 123*l* and the cutting tool 133*l* is l1, and the distance between the core block 123*l* and the wedge tool 143*l* is l2, regarding the wire W2 set to have a coil diameter m, the distance between the core block 123*m* and the cutting tool 133*m* is m1, and the distance between the core block 123*m* and the wedge tool 143*m* is m2, and regarding the wire W3 set to have a coil diameter n, the distance between the core block 123*n* and the cutting tool 133*n* is n1, and the distance between the core block 123*n* and the wedge tool 143*n* is n2, even if the tool assembly 120 is moved in the vertical direction so as to change the coil diameter, the relation l1=m1=n1 and l2=m2=n2 always holds. This omits labor to re-adjust the relative positional relation among the core block, the point tool, the wedge tool, the push tool and the cutting tool when these parts are removed from the forming table and exchanged with other parts in accordance with necessity.

Further, since all the cutting-tool drive motor 136, the wedge-tool drive motor 146, the push-tool drive motor 156 and the point-tool drive motor 166 are mounted on the tool assembly 120, once the relative positional relation among the drive motors and the respective tools is adjusted, it is not necessary to re-adjust the positional relation.

Further, this omits the conventionally required complicated transmission mechanism such as a belt mechanism, a link mechanism and the like, and omits an adjustment mechanism for adjusting the positional relation among the core block and the respective tools, thus reducing the number of parts and attaining reduction of cost.

Further, as the core block 123, the cutting tool assembly 130, the wedge tool assembly 140 and the push tool assembly 150 are fixed on the single tool assembly base 121, attaching strength of the core block and the respective tools is improved.

[Construction of Controller]

Next, the construction of a controller of the spring manufacturing machine 10 of the present embodiment will be described.

Figure 12:
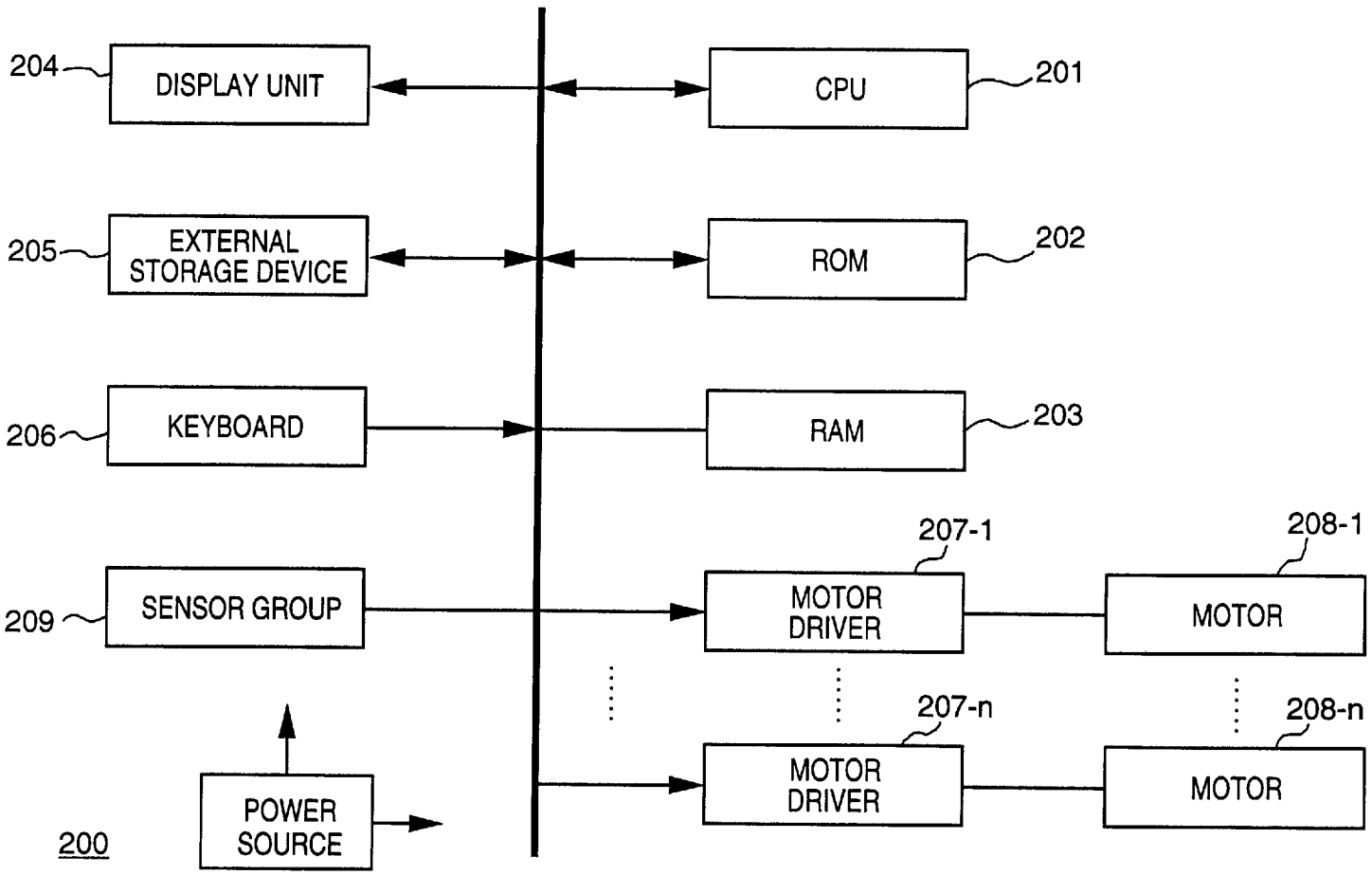
FIG. 12 is a block diagram showing the relation between a tool assembly 100 and a controller 200 in a spring manufacturing machine 10.

FIG. 12 is a block diagram showing the relation between a tool assembly 100 and a controller 200 in the spring manufacturing machine 10.

As shown in FIG. 12, a CPU 201 controls the overall controller 200. The operation processing contents (programs) of the CPU 201 and various font data are stored in a ROM 202. A RAM 203 is used as a work area for the CPU 201. A display unit 204 is provided for various settings, displaying the contents of the settings, and further, displaying a graph indicative of manufacture process and the like. An external storage device 205 is a floppy disk drive and the like, and is used for supplying a program from an external device, or storing the contents of various settings for wire-forming process. For example, if parameters for a wire-forming process (e.g., if the object shape is a spring, its free length and diameter), are stored into the storage device 205, the forming process can be executed any time by setting the storage device 205, thus springs of the same shape can be manufactured.

A keyboard 206 is provided for setting various parameters. A sensor group 209 is provided for detecting a wire-feed amount, the free length of a spring and the like.

The respective motors 208-*l* to 208-*n* are the above-mentioned feed-roller driver motor 105, the cutting-tool drive motor 136, the wedge-tool drive motor 146, the push-tool drive motor 156 and the point-tool drive motor 166. The respective motors 208-*l* to 208-*n* are driven by the respectively corresponding motor drivers 207-*l* to 207-*n*.

In this control block, the CPU 201 independently drives the various tool motors in accordance with instructions inputted from the keyboard 206, and controls input/output to/from an external device, further, controls the display unit 204.

Note that the present invention is not limited to the above embodiments and various changes and modifications can be made within the spirit and scope of the present invention.

For example, the tool assembly 120 is moved in the vertical direction by using a rack-and-pinion mechanism, however, a worm gear or the like can be employed instead of the rack-and-pinion mechanism.

Further, it may be arranged such that a plurality of point tool assemblies 160 are provided on the semicircular table and the wire W is placed against the plurality of point tools and rolled into coils.

[Advantages]

As described above, the spring manufacturing machine of the present embodiment has a base movable in a vertical direction on a forming table, pitch generation means which intervenes a pitch tool between coils of a wire, being continuously rolled by coiling means, so as to grow coils having a predetermined pitch, pitch-tool drive means which slide-drives the pitch tool, and a core block which applies a cutting force to the wire in cooperation with a cutting tool. This construction enables easy setting of a coil diameter and the like without changing the relative positional relation among the core block for cutting the wire and the tools for providing a predetermined coil diameter and a predetermined pitch to the wire.

Further, the above construction simplifies transmission mechanisms conventionally required for driving the tools, thus reducing cost.

As many apparently widely different embodiments of the present invention can be made without departing from the spirit and scope thereof, it is to be understood that the invention is not limited to the specific embodiments thereof except as defined in the appended claims.

What is claimed is:

1. A spring manufacturing apparatus having a main body and a table extending therefrom, said apparatus feeding a wire to be made into a spring, coiling said wire and cutting said wire by using tools provided on said table and main body, said table having a surface approximately parallel to an axis of said wire, said apparatus comprising, on said table and main body:

feeding means for feeding said wire;

coiling means for coiling said wire by placing said wire against a coiling tool;

coiling-tool drive means for slide-driving said coiling tool; and a base attached on said table movable in a vertical direction with respect to said table, and wherein said apparatus further comprising, on said base:

pitch generation means for inserting a pitch tool between coils of said wire being continuously coiled by said coiling means and growing coils having a predetermined pitch in an approximate normal-line direction with respect to said table;

pitch-tool drive means for slide-driving said pitch tool; and a core block for applying a cutting force to said wire in cooperation with a cutting tool for cutting said wire, said cooling means being provided movably on the surface of the table.

2. The spring manufacturing apparatus according to claim 1, further comprising cutting means for cutting said wire by using said cutting tool, and cutting-tool drive means for slide-driving said cutting tool, on said base.

3. The spring manufacturing apparatus according to claim 1, wherein said base is movable in the vertical direction with respect to said table by a rack and pinion mechanism.

4. The spring manufacturing apparatus according to claim 1, wherein said coiling tool is slide-driven toward said core block, and abuts against said wire in a plane.

5. The spring manufacturing apparatus according to claim 1, wherein said pitch generation means has:

wedge means for inserting a wedge tool, provided slidably along a lengthwise direction of said base toward said core block, between coils of said wire being continuously coiled by said coiling means and growing coils having a predetermined pitch; and push means for inserting a push tool, provided slidably in an approximate normal-line direction with respect to said base, between coils of said wire being continuously coiled by said coiling means and growing coils having a predetermined pitch.

6. The spring manufacturing apparatus according to claim 2, wherein said core block is fixed at approximately a center of said base, and wherein said pitch generation means and said cutting means are provided along a vertical direction with respect to said core block, opposing to each other, slidably toward said core block.

7. The spring manufacturing apparatus according to claim 2, further comprising control means for controlling said coiling-tool drive means, said pitch-tool drive means and said cutting-tool drive means.

8. A position adjustment apparatus, used in a spring manufacturing apparatus having:

adjacent to a table having a surface approximately parallel to an axis of said wire, feeding means for feeding a wire to be made into a spring;

coiling means, provided on said table, for coiling said wire by placing said wire against a coiling tool;

coiling-tool drive means for slide-driving said coiling tool, pitch generation means for inserting a pitch tool between coils of said wire being continuously coiled by said coiling means and growing coils having a predetermined pitch in an approximate normal-line direction with respect to said table;

pitch-tool drive means for slide-driving said pitch tool; and a core block for applying a cutting force to said wire in cooperation with a cutting tool for cutting said wire, said position adjustment apparatus, for adjusting a positional relationship of said tools or said core block or said tools and said core block with respect to said table, comprising:

a base, provided on said table, movable in a vertical direction with respect to said table, wherein said pitch generation means, the pitch-tool drive means and said core block are mounted on said base, and wherein said base is moved in the vertical direction with respect to said table without changing the positional relationship among said pitch generation means, said pitch-tool drive means and said core block.

9. The position adjustment apparatus according to claim 8, further comprising cutting means for cutting said wire by using said cutting tool, and cutting-tool drive means for slide-driving said cutting tool, on said base.

10. The position adjustment apparatus according to claim 8, wherein said base is movable in the vertical direction with respect to said table by a rack and pinion mechanism.

11. The position adjustment apparatus according to claim 9, wherein said core block is fixed at approximately the center of said base, and wherein said pitch generation means and said cutting means are provided along a vertical direction with respect to said core block, opposing to each other, slidably toward said core block.

* * * * *